US010648161B2

(12) United States Patent
Reilly, Jr. et al.

(10) Patent No.: US 10,648,161 B2
(45) Date of Patent: May 12, 2020

(54) DEVICE FOR THAWING FROZEN PIPES

(71) Applicants: Patrick Anthony Reilly, Jr., Salem, MA (US); James Francis Decareau, Salem, MA (US)

(72) Inventors: Patrick Anthony Reilly, Jr., Salem, MA (US); James Francis Decareau, Salem, MA (US)

( * ) Notice: Subject to any disclaimer, the term of this patent is extended or adjusted under 35 U.S.C. 154(b) by 117 days.

(21) Appl. No.: 15/932,672

(22) Filed: Apr. 5, 2018

(65) Prior Publication Data

US 2019/0309502 A1 Oct. 10, 2019

(51) Int. Cl.
*F16L 53/00* (2018.01)
*E03B 7/14* (2006.01)

(52) U.S. Cl.
CPC ..... *E03B 7/14* (2013.01)

(58) Field of Classification Search
CPC ..... E03B 7/14
USPC ..... 138/32, 34, 35
See application file for complete search history.

(56) References Cited

U.S. PATENT DOCUMENTS 1,361,023 A 12/1920 Darley
1,702,972 A * 2/1929 Larsen ..... F17D 1/05 137/269
2,670,130 A * 2/1954 Bloxsom ..... B60T 17/02 303/10
3,384,123 A * 5/1968 Saddison ..... B60S 1/50 138/34
3,767,117 A 10/1973 Baker
4,102,358 A 7/1978 Sherock
4,124,039 A 11/1978 St. Laurent
4,250,925 A * 2/1981 Mast ..... F16L 53/32 138/35
4,449,553 A * 5/1984 Sullivan ..... E03B 7/14 138/35
4,531,538 A * 7/1985 Sandt ..... E03B 7/10 137/301
5,193,587 A 3/1993 Miller, Jr.
(Continued)

*Primary Examiner* — James F Hook
(74) *Attorney, Agent, or Firm* — Kaleb Pan; The Law Office of Kaleb Pan, Esq.

(57) ABSTRACT

Disclosed herein is a device for injecting pressurized alcohol solution into a pipe located in a house or other structure that carries water. The device allows the user to control and adjust the pressure of the injected alcohol solution. The pressure forces the alcohol solution against the frozen water inside the pipe. The alcohol solution then acts to dissolve the ice, thereby clearing the blockage and preventing damage to the pipe. The device is hand held, portable and configurable. The embodiment of the device with the hand-operated pump does not require electricity or other sources of power. Alternate embodiments of the device can be broken down into two or more sections for easier storage. Alternate embodiments of the device has one or more of the lengths of connecting pipe or connector or adapter bends at an angle so that the device is not configured in a straight line but has a bend or curve. These alternate embodiments allows for the device to fit into tight or restricted spaces. Alternate embodiments of the device utilize fittings, connectors, valves, gauges, vents and lengths of pipe of different sizes, lengths, diameters and materials. Different solutions or solvents other than an alcohol solution may be used. Also disclosed is the method of using the device.

7 Claims, 4 Drawing Sheets

(56) References Cited

U.S. PATENT DOCUMENTS

| | | | | |
|---|---|---|---|---|
| 5,293,904 | A * | 3/1994 | Wood | E03C 1/304 138/34 |
| 5,488,968 | A * | 2/1996 | Price | E03B 7/12 137/1 |
| 5,715,869 | A * | 2/1998 | Patterson | B08B 9/0433 |
| 8,662,098 | B2 * | 3/2014 | Foster | E03B 7/12 137/209 |
| 2009/0095367 | A1 * | 4/2009 | Socha | B60T 17/043 138/34 |
| 2010/0116357 | A1 * | 5/2010 | Lebreux | B60T 17/221 137/351 |
| 2013/0087235 | A1 * | 4/2013 | Shelton | E03B 7/14 138/35 |

* cited by examiner

DEVICE FOR THAWING FROZEN PIPES

BACKGROUND OF THE INVENTION

1. FIELD OF THE INVENTION

The present disclosure relates generally to the field of plumbing devices, more particularly the thawing of frozen water pipes within a building. The mechanical device utilizes air pressure to inject an alcohol solution into pipes to remove blockages caused by water frozen within the pipe.

2. SUMMARY

The following presents a simplified summary of the disclosure in order to provide a basic understanding to the reader. This summary is not an extensive overview of the disclosure and it does not identify key/critical elements of the present invention or delineate the scope of the present invention. Its sole purpose is to present some concepts disclosed herein in a simplified form as a prelude to the more detailed description that is presented later.

The present invention provides a reliable and affordable device to thaw frozen pipes without the need to determine the location of the frozen section of the pipe.

In particular, the invention relates to a device and method of using same which enables the user to thaw water pipes used in regulating temperature in a commercial or residential building or pipes carrying water. The device has further application in thawing any other pipe carrying liquid that has frozen.

In cold weather when outside temperatures reach below the freezing point of water, when a homeowner or building occupant opens up a water faucet and observes that no water or only a trickle is coming out or if the toilets do not refill following a flush, a likely conclusion is that a pipe leading to that faucet has frozen. The same is true if it is discovered that a building with a water-based heating system (such as baseboard heating) is not heating up and it is discovered that water is failing to circulate within the closed looped pipes. An untreated frozen pipe will eventually burst.

If the affected pipes are exposed, such as under a sink, in a basement or along the exterior of the house, it may be possible to locate the frozen portions of the pipe. Frozen pipes often have frost on them or may have a slight bulge. However, many pipes are inaccessible, being enclosed within walls, under floors or encased within a concrete foundation. If the blockage is located in an accessible section of the pipe, there are more options for easily thawing the pipe than if the frozen portion is enclosed and inaccessible. One method to thaw pipes is to leave faucets open to allow the trickle of water to eventually melt the ice. This is a very slow process and is not available if there is no heat in the building. Other methods are to use a heat gun, hair dryer, heat tape, towel wrapping or some other method to thaw the frozen section of the pipe. These methods only work when the pipes are exposed and the frozen section can be located.

If the frozen pipe is located in an area that is not easily accessible, it may be possible to slowly thaw the ice by pouring hot water, saltwater or alcohol down a drain. These methods only works if the frozen pipe is down-stream from the drain and with hot water, there is a risk of causing the pipes to burst from the sudden change of temperature. The homeowner or building occupant can also turn the heat up in the property with the hopes of encouraging the ice blockage to slowly melt. Again, this assumes that heat and/or power is available in the building which would not be the case if the water heating system pipes are frozen. An infrared lamp placed in front of the portion of the wall where the pipe is located will heat up that specific area and may be able to penetrate the wall and slowly allow the pipe to defrost. Other solutions involve wrapping the frozen pipe with heat tape or passing electrical current through the affected pipes. A more drastic approach is to cut out a section of the drywall in front of the frozen to access the pipe and use any of the other methods for heating up that section of the pipe. These solutions assumes that the frozen section can be located and creates a mess in order to access those frozen sections. Also, it would not be possible with pipes encased in concrete without heavy drilling and destruction of the concrete.

With any of the methods above, there is always a risk of causing the pipe to burst due to a sudden buildup of pressure or changes of temperature from heated water. Burst pipes are costly to repair and can cause great property loss.

This device utilizes the ice melting properties of alcohol solutions. Alcohol has a much lower freezing point than water and acts to melt ice. A solution of alcohol could be poured into a frozen pipe directly but it would only flow down a slope. There is no way to force the alcohol solution to circulate through the pipe to the frozen section. Also, even if the alcohol solution reaches the ice blockage, without pressure, the solution will act slowly to dissolve the ice.

The disclosed, preferred, embodiment of the device is a hand-held implement comprised of an hand operated air pump connected to a T connector with one "arm" connected to a second check valve connected by an adapter to a flexible intake hose for an alcohol solution. The check valve maintains the pressure within the apparatus and prevents backflow. The other "arm" of the T connector is connected to a second check valve that is followed by a pressure gauge (either analog or digital).

The T connector should be configured so that the straight portion of the connector which allows for a straight direction of travel should be connected to the pump and the check valve leading to the pressure gauge. The "arm" of the T connector that is positioned perpendicular or at an angle to this straight direction of travel should be connected to the check valve leading to the flexible intake hose.

Following the pressure gauge is an adjustable air vent which serves to relieve excess pressure. Following the air vent is an adapter which connects the device to one end of the blocked pipe.

In between each check valve, gauge, vent and the pump are short lengths of pipe or tubing to aide in connecting the various components. The pipe or tubing of the apparatus may be made of standard ferrous-based plumbing materials such as brass, copper or black pipe or any other suitably strong and rigid materials.

The device can be operated manually by hand, without power. Alternatively, an air compressor or mechanical pump can be substituted for the hand pump to pressurize the solution. The invention is not limited by the capacity of the air pump.

The device can be connected to the blocked pipe at a location where a pipe connects to the boiler or a check valve or near the frozen segment if the pipe is accessible and the frozen section is known.

The device can be scaled up by attaching a larger air pump and utilizing higher gauge fittings to thaw larger diameter pipes that have frozen.

It is a feature of the invention that the device can utilize ½ inch pipe fittings, ¾% inch pipe fittings or larger diameter fittings. Higher diameter pipe fittings would allow for larger application including higher capacity industrial uses.

It is an additional feature of the invention that the device will work to thaw pipes regardless of the material of the pipe. It is thus not limited in its application to the material of the pipe being thawed.

The device can be configured to attach to the affected pipe in a straight line or at an angle depending on the adapter or connector used. This assists in the use of the device in locations where space is restricted. For example, the device will function in the same way even with a ninety-degree adapter fitted to the device and connecting it to the blocked pipe.

It is a feature of the invention that the device will accommodate both right handed and left handed users.

It is a feature of the invention that the device is configurable by swapping out individual components. The separate fittings, connectors, valves, gauges, vents and lengths of pipe are also replaceable by functionally similar components or by components which combine functionalities or performs multiple functions. For example, a single component that combines both a pressure gauge and an air vent could be substituted for the separate pressure gauge and air vents as depicted in the drawings.

A second embodiment of the invention includes a union connector in the middle of the device to allow it to be disassembled into two shorter lengths. The union connector can be located between the second check valve and the pressure gauge. This connector assists in the portability of the device but is not required for the functioning of the device.

The handheld embodiment of the device works by first connecting the device to the effected pipe using the appropriate adapter at the end opposite from the air pump. The unattached end of the flexible intake hose or tube is placed in a bucket of alcohol solution. The operator then begins pumping the pump handle. Positive air pressure is created within the device which draws an alcohol solution from a separate container connected into the apparatus via the intake hose. The alcohol solution is injected into the device through the intake hose or tube connected to the apparatus via a check valve. The check valve connected to the intake hose prevents the pressurized air from inside the device from escaping into the intake hose while allowing the alcohol solution to be drawn through it into the device. The check valve further functions to allow only one-way flow of air or liquids, preventing back-flow and maintaining positive air pressure within the device. The alcohol solution is pushed through the device and through a second check valve further along the apparatus. The check valve is connected to a length of pipe or tubing which is then connected to a pressure gauge. The pressure gauge provides the operator with the ability to monitor the pressure in the pipe and avoid over-pressurizing the pipe and causing damage to it. The pressure gauge is connected to a length of pipe or tubing which is connected to an adjustable air vent. The adjustable air vent, which allows only one-way, outgoing airflow relieves excess air pressure while preventing air from entering the device.

The apparatus pressurizes the alcohol solution and injects the solution into the blocked pipe. An alcohol solution which is 70% alcohol may be used. Isopropyl or alcohol can also be used.

When the alcohol solution reaches the ice blockage, the pressure building up behind it will force the solution to flow around the ice, melting the outer layers of ice until the ice is loosened and eventually detaches from the walls of the pipe, relieving the blockage.

The amount of alcohol solution will vary depending on the size and length of the plumbing system being thawed. Different solutions or solvents and solutes other than an alcohol solution may be used in the device.

The pressurized alcohol solution can act to melt additional ice blockages down the pipe's length.

Once flow has been restored in the affected pipe, the device can be removed and the pipe re-sealed.

An alternate embodiment of the device utilizes a mechanical pump in place of the hand pump. The remainder of the device would function in the same manner as with the handheld embodiment of the device.

Although the invention is illustrated and described herein as embodied in a portable, handheld device using off the shelf pipe fittings, it is nevertheless not intended to be limited to the details shown because various modifications and structural changes may be made therein without departing from the spirit of the invention and would be within the scope and range of equivalents of the claims.

The construction of the invention together with the advantages thereof will be best understood from the following description of specific embodiments when read in connection with the accompanying drawings.

3. DESCRIPTION OF RELATED ART

Much of the related art attempting to solve the same problem of thawing frozen pipes rely on the application of heat. There are numerous patents for pipe heating systems, with some systems applying heat to the outside of the pipe and others applying heat from within the pipe.

Another related art method of thawing a frozen pipe is contained in Patent Application 62/040,737—Electrical Pipe Thawing System and Methods of Using the Same or Patent US 20160053468 A1. This method involves electrically charging a section of frozen pipe and allowing the resistance to the electrical current to melt the build up of ice within.

Other related art involves forcing hot water into the pipes to melt the ice blockage. One such patent (U.S. Pat. No. 4,124,039A—Pipe Thawing Machine) pressurizes hot water into the pipe using a pressure tank, flexible tubing and a return reservoir. This present invention differs from U.S. Pat. No. 4,124,039A in the construction of the disclosed embodiment, the ability for the device to be operated by hand without power or heat and in the fact that an alcohol solution and not hot water is being injected into the affected pipe.

It is the object of the present invention to provide a device and a method for use that facilitates the easy, simple and low cost method of de-thawing frozen pipes. This application is useful for use by professionals and for homeowners alike.

It is an object of the invention to provide a device and a method for use that can be utilized to de-thaw frozen pipes without having to locate the specific sections of pipe that have frozen.

It is an object of the invention to provide a device and a method for use that can be utilized by any person for thawing frozen pipes regardless of the person's lack of experience in this art.

Other pipe thawing devices or methods may achieve the same end result, however they typically require access to the frozen section of the pipe, knowledge of where the frozen section is, or employs hot water which can result in burst or cracked pipes from sudden temperature changes. Some of these other devices or method require access to electricity or hot water. These limitations or risks are overcome by the use of this disclosed invention.

Further, other pipe thawing devices are more complicated or difficult to use, are more costly to produce, require more space to store or are limited in their functionality.

In view of the foregoing, there exists a need for a simple, affordable and durable means (e.g., devices and/or methods) that unblock frozen pipes.

4. DETAILED DESCRIPTION

The detailed description provided below in connection with the drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

For convenience, certain terms employed in the entire application (including the specification, examples, and appended claims) are collected here. Unless otherwise defined herein, scientific and technical terminologies employed in the present disclosure shall have the meanings that are commonly understood and used by one of ordinary skill in the related art. Unless otherwise required by context, it will be understood that singular terms shall include plural forms of the same and plural terms shall include the singular. Specifically, as used herein and in the claims, the singular forms "a" and "an" include the plural reference unless the context clearly indicates otherwise.

According to one embodiment of the present disclosure, the device comprises a hand operated air pump connected to a check valve to hold the pressure and to prevent back-flow, followed by a T connector that is connected to a second check valve connected to a flexible intake hose for an alcohol solution. The T connector is also connected to a third check valve that is followed by a pressure gauge (either analog or digital). Following the pressure gauge is an air vent which serves to relieve excess pressure. Following the air vent is an adapter which connects the device to one end of the blocked pipe. In between each check valve, gauge, vent and the pump are short lengths of pipe through which the alcohol solution flows.

According to various embodiments of the present invention, the method of using the device as embodied in the present disclosure to thaw a frozen pipe comprises the following steps:

(a) The user prepares a sufficient amount of alcohol solution in a container and places the flexible intake hose from the device into the container in contact with the solution.

(b) The user will need to locate an opening in the plumbing system with the suspected ice blockage where the device may be attached. This can be at the location where the affected pipe connects to a boiler or a draw off valve.

(c) The user than attaches the device to the affected pipe with the blockage using the appropriate size adapter.

(d) The user would pump the hand pump on the device to draw the alcohol solution from the container through the intake hose.

(e) The user would continue to pump the device, injecting the alcohol solution into the affected pipe.

(f) Initially, the user will find the device easy to pump as the alcohol solution is being injected through the empty portions of the pipe. When the alcohol solution reaches the ice blockage, however, the user will need to utilize more strength to pump the device while paying attention to the pressure gauges on the device. Ideally, the pressure should not exceed 70-80 psi (pounds per square inch) within the pipe. This number varies depending on the material of the pipe.

(g) Once the maximum recommended pressure is reached, the user should stop pumping and monitor the pressure gauge. Additional pumping may be required to hold the pressure at the same level until the alcohol solution dissolves the ice blockage or loosens it from the inside surface of the pipe. The user will know that this has occurred because the pressure gauge will show a sudden drop in pressure.

(h) If there are no additional ice blockages down the line in the pipe, the user can stop pumping, detach the device from the affected pipe, reattach the pipe to the system and recirculate water if desired.

(i) If there are additional ice blockages along the pipe, the user would continue to pump the alcohol solution through the pipe until the next ice blockage is reached. Then the user would repeat the above steps until the ice blockage has been loosened or dissolved.

According to various embodiments of the present invention where the hand pump is replaced by a mechanical means of pressurizing the interior of the device (i.e. an electrical pump), the method of using the device as embodied in the present disclosure to thaw a frozen pipe, step (d) in the list of steps above is replaced with:

(d1) The user would turn on the electrical pump attached to the device to draw the alcohol solution from the container through the intake hose.

(e1) The user would continue to operate the pump on the device, injecting the alcohol solution into the affected pipe.

(f1) The user would pay special attention to the pressure gauges on the device. Ideally, the pressure should not exceed 70-80 psi (pounds per square inch) within the pipe. The ideal pressure level will vary depending on the material of the pipe. Flexible pipes such as PEX can expand slightly and will tolerate higher pressure. Brittle pipes such as cast iron pipes will require lower pressure.

(g1) Once the maximum recommended pressure is reached, the user should turn off the pump and monitor the pressure gauge. Additional pumping may be required to hold the pressure at the same level until the alcohol solution dissolves the ice blockage or loosens it from the inside surface of the pipe. The user will know that this has occurred because the pressure gauge will show a sudden drop in pressure.

(h1) If there are no additional ice blockages down the line in the pipe, the user can turn off the electrical pump, detach the device from the affected pipe, reattach the pipe to the system and recirculate water if desired.

(i1) If there are additional ice blockages along the pipe, the user would continue to pump the alcohol solution through the pipe until the next ice blockage is reached. Then the user would repeat the above steps until the ice blockage has been loosened or dissolved.

According to various embodiments of the present invention, the method of using the device as embodied in the optional embodiment where the invention includes a union connector in the middle of the device to allow it to be disassembled into two shorter lengths. This assists in the portability of the device but is not required for the functioning of the device.

Minor changes in shape, size and rearrangement of details and parts such as come within the purview of the invention claimed may be resorted to, in actual practice, if desired.

The lengths of pipe and the fittings and connectors in the invention may be made of standard ferrous-based plumbing materials such as brass, copper or black pipe or any other suitably strong materials.

A digital pressure gauge may be used on the device to measure the internal pressure of the invention and the affected pipe rather than an analog pressure gauge.

Some mechanical pumps are equipped with automatic shut off features which can be configured for certain pressure levels. Such mechanical pumps can be utilized and configured to stop pumping upon reaching the recommended pressure level.

According to some optional embodiments of the present disclosure, the diameter and lengths of the pipes and fittings comprising the invention may be of various widths and the lengths.

According to other optional embodiments of the present disclosure, a second electrical pump may be attached to the flexible intake hose to aid in siphoning up the alcohol solution into the invention.

According to other optional embodiments of the alternate disclosure where the device may be disassembled into two separate pieces, the union connector may be located anywhere along the length of the device and not necessarily at the center.

According to other optional embodiments of the alternate disclosure where the device may be disassembled into separate pieces, more than one union connector may be located anywhere along the length of the device in order to allow for disassembly and portability on the invention.

According to other optional embodiments of the alternate disclosure where the device may be disassembled into two or more separate pieces, the union connector may be substituted with other suitable means of connecting the lengths of pipe in the device.

According to other optional embodiments of the alternate disclosure where one or more of the sections of pipe or a connector or adapter contains an angle, allowing the device to fit into tight or restricted spaces.

The invention as in the current embodiment may be used in combination with other devices according to other optional embodiments.

It will be understood that the above description of embodiments is given by way of example only and that various modifications may be made by those with ordinary skill in the art. The above specification, examples, and data provide a complete description of the structure and use of exemplary embodiments of the invention. Although various embodiments of the invention have been described above with a certain degree of particularity, or with reference to one or more individual embodiments, those with ordinary skill in the art could make numerous alterations to the disclosed embodiments without departing from the spirit or scope of this invention.

Many of the attendant features and advantages of the present disclosure will becomes better understood with reference to the following detailed description considered in connection with the accompanying drawings.

5. BRIEF DESCRIPTION OF THE DRAWINGS

The present description will be better understood from the following detailed description read in light of the accompanying drawings, where:

Figure 1:
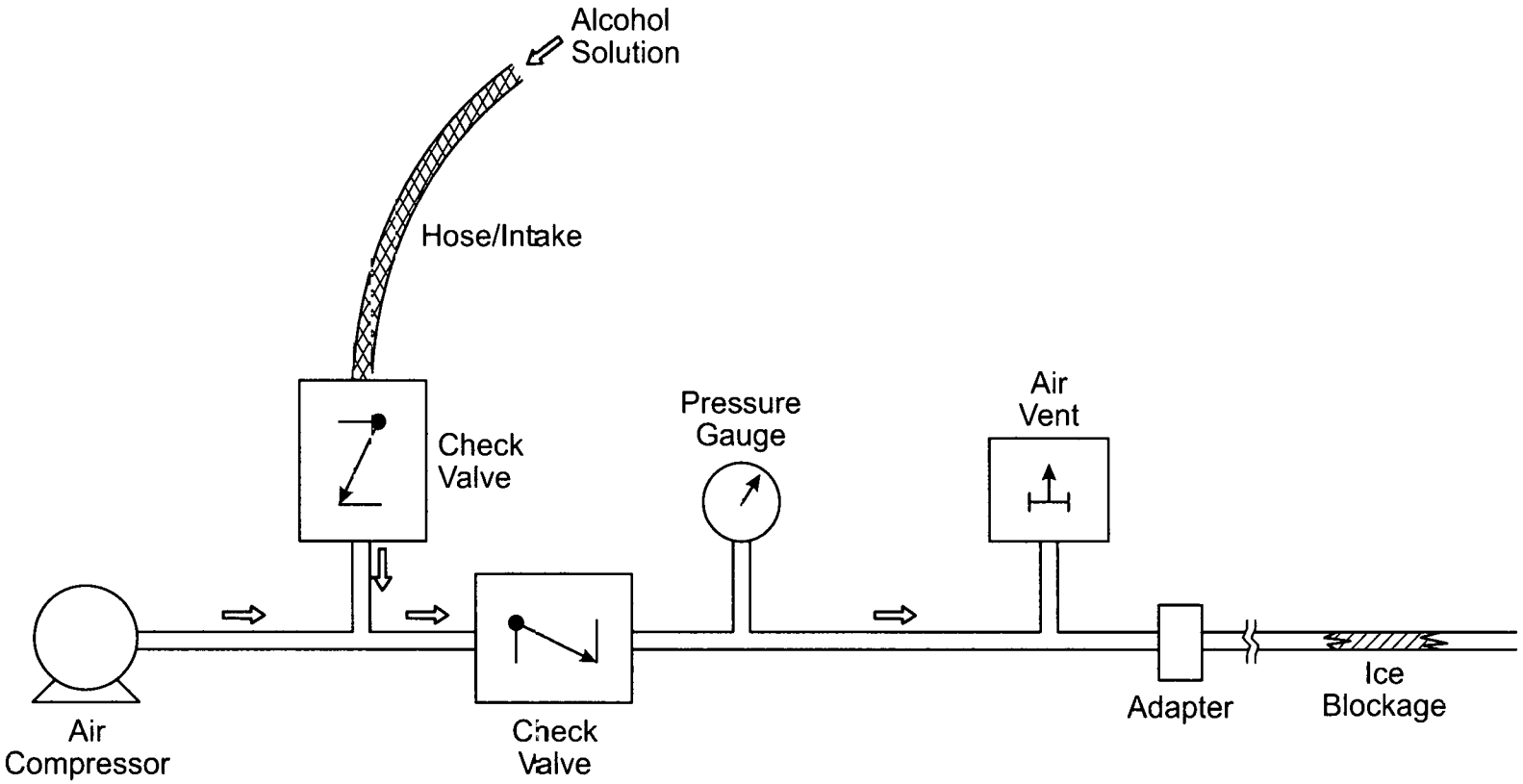
FIG. 1 is a schematic diagram illustrating a device for pumping pressured alcohol solution into a pipe in order to melt a ice blockage within that pipe.
Figure 2:
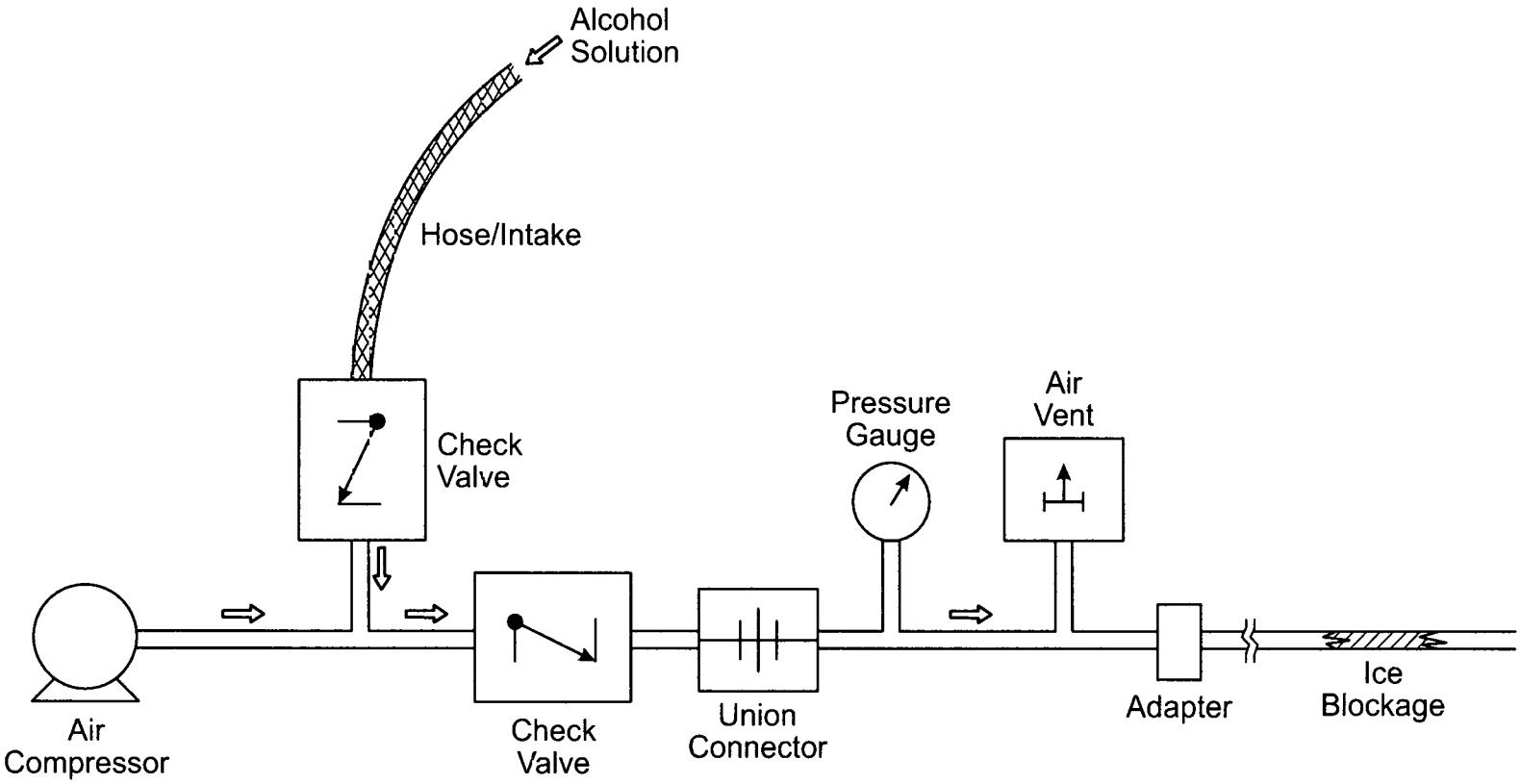
FIG. 2 is a schematic diagram illustrating the same device as in FIG. 1 but with a union connector or other means of connecting pipes is depicted.
Figure 3:
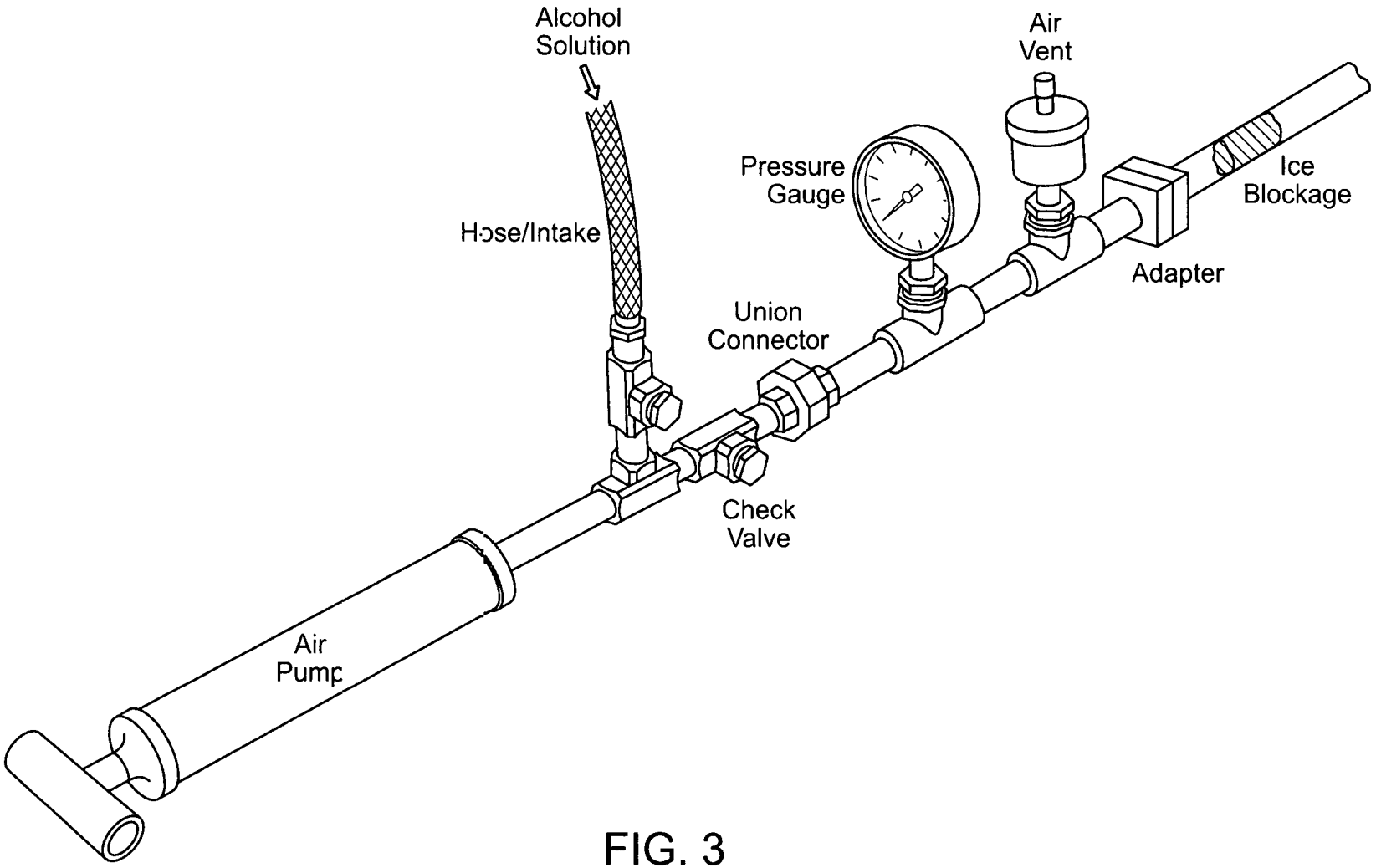
FIG. 3 is a perspective view illustrating the same device with a union connector in the approximate middle of the length of the device.
Figure 4:
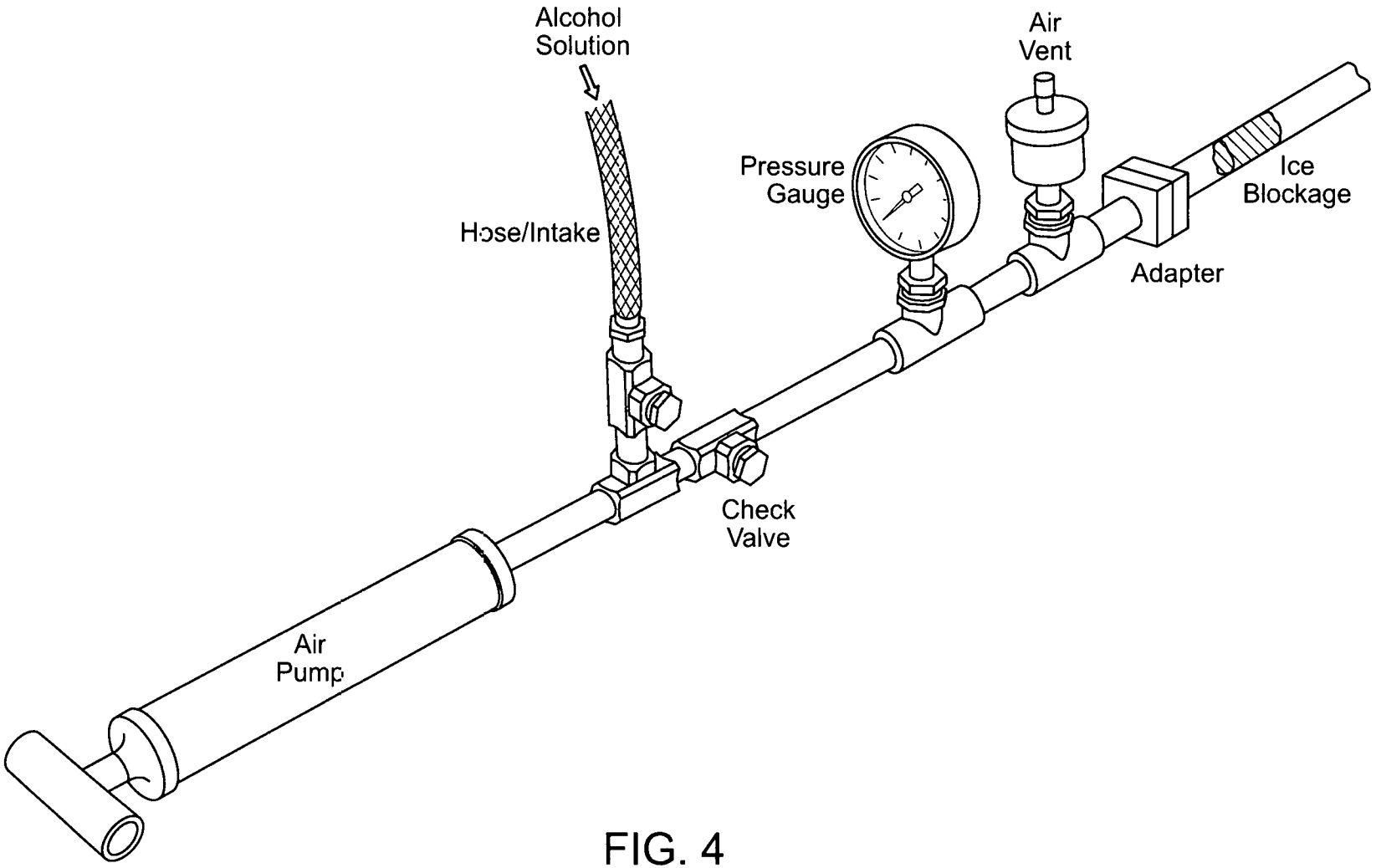
FIG. 4 is a perspective view illustrating a device for pumping pressured alcohol solution into a pipe in order to melt an ice blockage within that pipe.

In accordance with common practice, the various described features/elements are not drawn to scale but instead are drawn to best illustrate specific features/elements relevant to the present invention. Also, like reference numerals and designations in the various drawings are used to indicate like elements/parts.

What is claimed is:

1. A device for pumping pressurized alcohol solution and other solutions into cross-linked polyethylene (PEX) pipes or tubing in order to melt a ice blockage within that pipe comprising, (a) a hand operated air pump or a means to compress air connected by a length of pipe to a T connector, (b) the perpendicular or angled "arm" of the T connector fitting is connected by a short length of pipe to a check valve fitting which functions to maintain positive pressure within the device and to prevent back-flow, (c) the check valve fitting is then connected by an adapter to a flexible intake hose for an alcohol solution, (d) the unconnected end of the flexible intake hose is immersed into a container filled with an alcohol solution, (e) the third "arm" of the T connector which is not connected to the pump or the check valve leading to the flexible intake hose is connected by a short length of pipe to a second check valve fitting, (f) the second check valve fitting is connected by a short length of pipe to a pressure gauge which could be either analog or digital, (g) the pressure gauge is connected by a short length of pipe to an adjustable air vent which the user can open incrementally to relieve excess pressure, (h) the air vent is connected by a short length of pipe to an adapter fitting that can fit onto an opening for the pipe with the ice blockage, (i) where all the fittings, valves, gauges and pipe components of the device should be air-tight and able to maintain positive pressure within, (j) and with the ideal internal pressure not to exceed 70-80 pounds per square inch when in use, until the PEX tubing expands slightly around the blockage.

2. The device of claim 1, wherein the means to compress air is a mechanical pump or air compressor.

3. The device of claim 1, wherein one or more union connectors are inserted between any of the fittings, allowing the device to be unassembled into two or more pieces for convenience or ease of storage.

4. The device of claim 1, wherein one or more of the sections of pipe or a connector or adapter bends at an angle, allowing the device to fit into tight or restricted spaces.

5. The device of claim 1, wherein the separate fittings, connectors, valves, gauges, vents and lengths of pipe are replaced by functionally similar components or by components which perform multiple functions.

6. The method of using the device of claim 1 to thaw frozen pipes.

7. The device of claim 1 with the embodiment in claim 3 wherein one union connector is located between the Pressure Gauge and the Check Valve and a second union connector is located between the air pump or compressor and the T connector leading to the intake hose, allowing the user to disconnect the section of the device between the union connectors and reassemble the section in the opposite orientation, thereby reversing the flow of the device, allowing it to exert negative pressure on the blocked pipe and pulling the blockage towards the user.

* * * * *